United States Patent [19]

Willamsson

[11] Patent Number: 4,958,805

[45] Date of Patent: Sep. 25, 1990

[54] WINDLASS FOR OFFSHORE STRUCTURES

[76] Inventor: Robert Willamsson, Västra Palmgrensgatan 75, S-42177 Västra Frölunda, Sweden

[21] Appl. No.: 443,021

[22] Filed: Nov. 30, 1989

Related U.S. Application Data

[63] Continuation of Ser. No. 192,006, May 9, 1988, abandoned.

[51] Int. Cl.[5] ..... B63B 21/16; B66D 1/72

[52] U.S. Cl. ..... 254/332; 114/293; 254/333; 254/343; 254/382

[58] Field of Search ..... 254/325, 332, 333, 334, 254/343, 356, 372, 379, 382; 114/293, 264, 265

[56] References Cited

U.S. PATENT DOCUMENTS

| | | | |
|---|---|---|---|
| 917,356 | 4/1909 | Pilling | 254/343 |
| 1,239,110 | 9/1917 | Knutson | 254/343 X |
| 1,833,484 | 11/1931 | Geer | 254/343 |
| 1,902,820 | 3/1933 | Ball | 254/343 X |
| 2,085,815 | 7/1937 | McCollum | 254/356 X |
| 2,553,031 | 5/1951 | Benson et al. | 254/343 |
| 3,080,583 | 3/1963 | Fuller | 114/264 X |
| 3,462,125 | 8/1969 | Gollwitzer et al. | 254/361 X |
| 3,658,299 | 4/1972 | Sprague | 254/343 |
| 3,687,418 | 8/1972 | Halvorsen | 254/361 X |
| 3,917,229 | 11/1975 | Ayme | 254/382 X |
| 4,150,635 | 4/1979 | Lloyd et al. | 114/264 X |
| 4,354,667 | 10/1982 | Svendsen | 254/334 X |
| 4,497,471 | 2/1985 | Longberg et al. | 254/372 |

FOREIGN PATENT DOCUMENTS

| | | | |
|---|---|---|---|
| 315441 | 12/1920 | Fed. Rep. of Germany | 254/343 |
| 3143273 | 5/1983 | Fed. Rep. of Germany | 254/343 |
| 615034 | 7/1978 | U.S.S.R. | 254/343 |
| 562 | of 1894 | United Kingdom | 254/343 |
| 2176568 | 12/1986 | United Kingdom | 114/293 |

*Primary Examiner*—Joseph J. Hail, III

*Attorney, Agent, or Firm*—Andrus,Sceales,Starke & Sawall

[57] ABSTRACT

A windlass for offshore structures comprises power mechanism (18) for rotation of a chain wheel (13) about a horizontal axis (24*a*) during maneuvering of an anchor chain (14) extending between an anchor and a chain box (15). The chain wheel (13) is rotatably supported in a wheel housing (24) which is pivotable about a vertical shaft (22) below the operating water line (OD) of the structure and on the outside of its planking.

6 Claims, 4 Drawing Sheets

WINDLASS FOR OFFSHORE STRUCTURES

This is a continuation of application Ser. No. 07/192,006, filed May 9, 1988 now abandoned.

The present invention relates to a windlass for offshore structures, such as semi-submersible platforms, docks or similar substantially stationary vessels, the windlass comprising power means for rotation of a chain wheel during maneuvering of an anchor chain extending between an anchor and a chain box.

Large floating offshore structures such as drilling, accommodation and production platforms for the oil industry employ several, usually at least eight anchors deployed in fan form for staying in the desired position. These anchors usually weigh about 15 tons each and are each provided with a chain of a length of about 1,500 m. The deployment of these anchors takes place by means of specially equipped tugs. The handling of these anchors necessitates powerful machinery that needs to be maneuverable individually in order to compensate for varying current and wind direction by adjusting the tension in the various anchor chains. Since it is extremely important that this positioning system must not fail, the windlasses are usually provided with double motors and strong brake systems.

In the prior art this heavy, bulky and expensive windlass equipment is placed on the main deck of a platform provided with pontoons so that the anchor chains may be led vertically down along the supporting legs of the platform via a sheave or fairlead which is pivotably mounted below the normal water line of the platform. From there on the chain extends in a curve down towards the sea floor and the anchor placed about 1 km away. Due to the chain extending vertically down along the supporting legs to below the water line, the platform is subjected to smaller heeling moments, and the risk of a supply vessel impinging on any of the chains is minimized.

On a drilling platform part of the drilling takes place without full blowout protection when one does not expect the drill bit to penetrate a gas containing layer. If an unexpected gas pocket should be reached in this condition, a blowout of combustible gas may happen and the gas could be ignited by the smallest spark on the drilling platform. Theoretically, the platform should be able to move several hundred meters out of the risk area by heaving in some of the anchor chains and paying out the others. In practice, however, there will always be certain spark generation in the contact between a coarse chain and a rotating chain wheel, and therefore this possibility for movement is too risky to be used.

The object of the present invention is to provide a simpler and cheaper windlass that can be placed in a more advantageous and also spark protected place on the offshore platform.

This is obtained according to the invention by having the chain wheel being rotatably supported in a wheel housing which is pivotable about a vertical axis below the operation water line of the vessel and on the outside of its planking.

Figure 1:
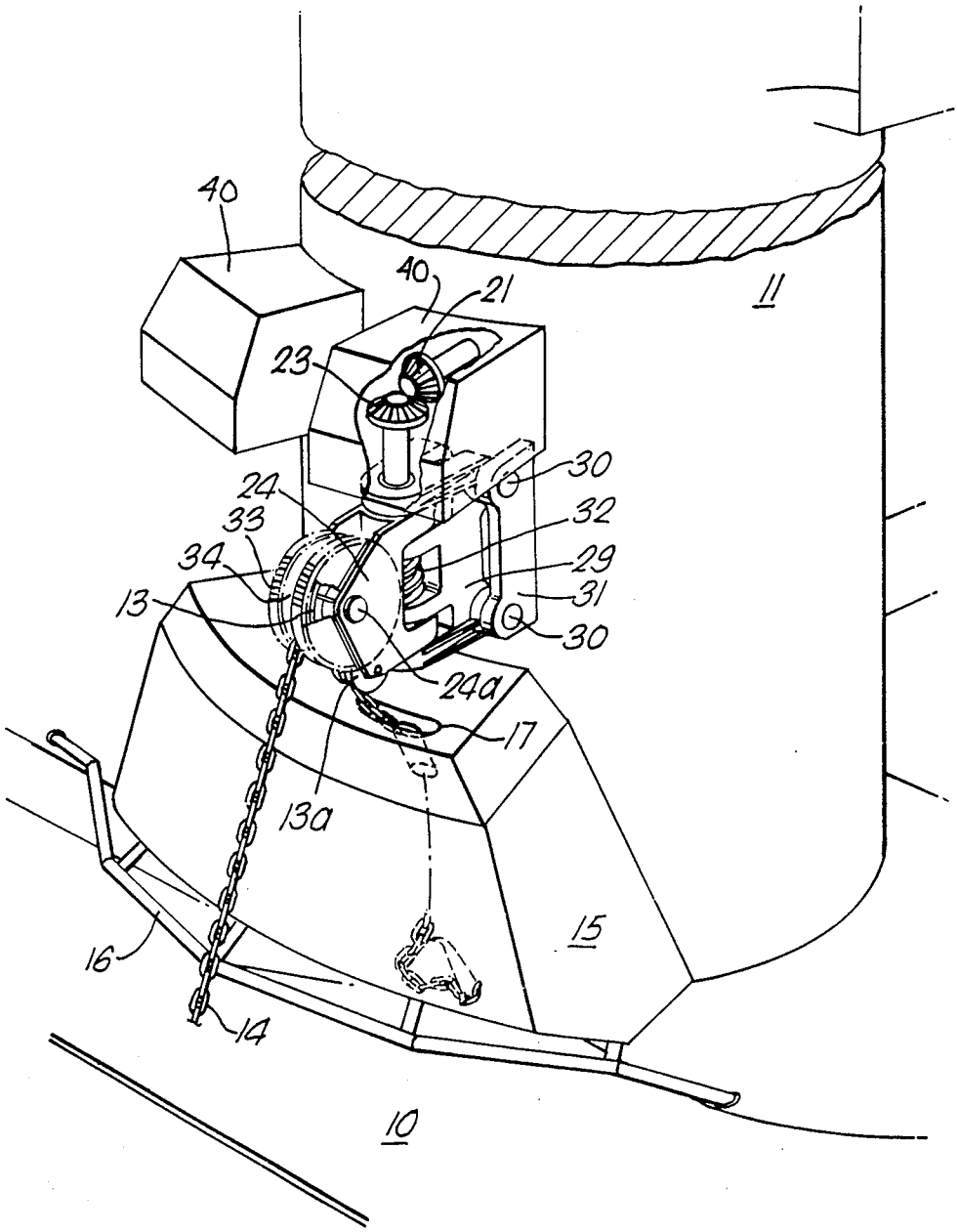
Figure 2:
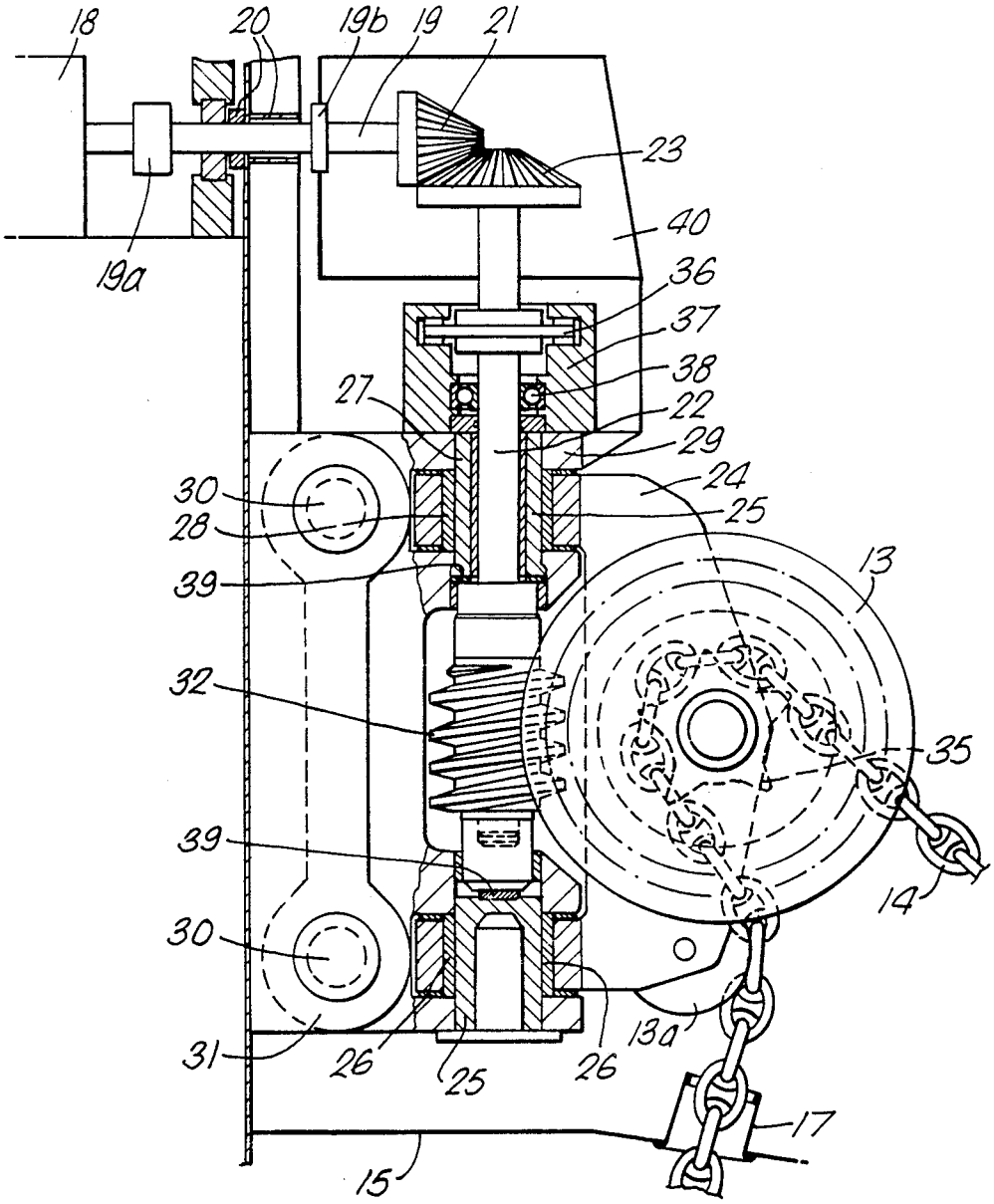
Figure 3:
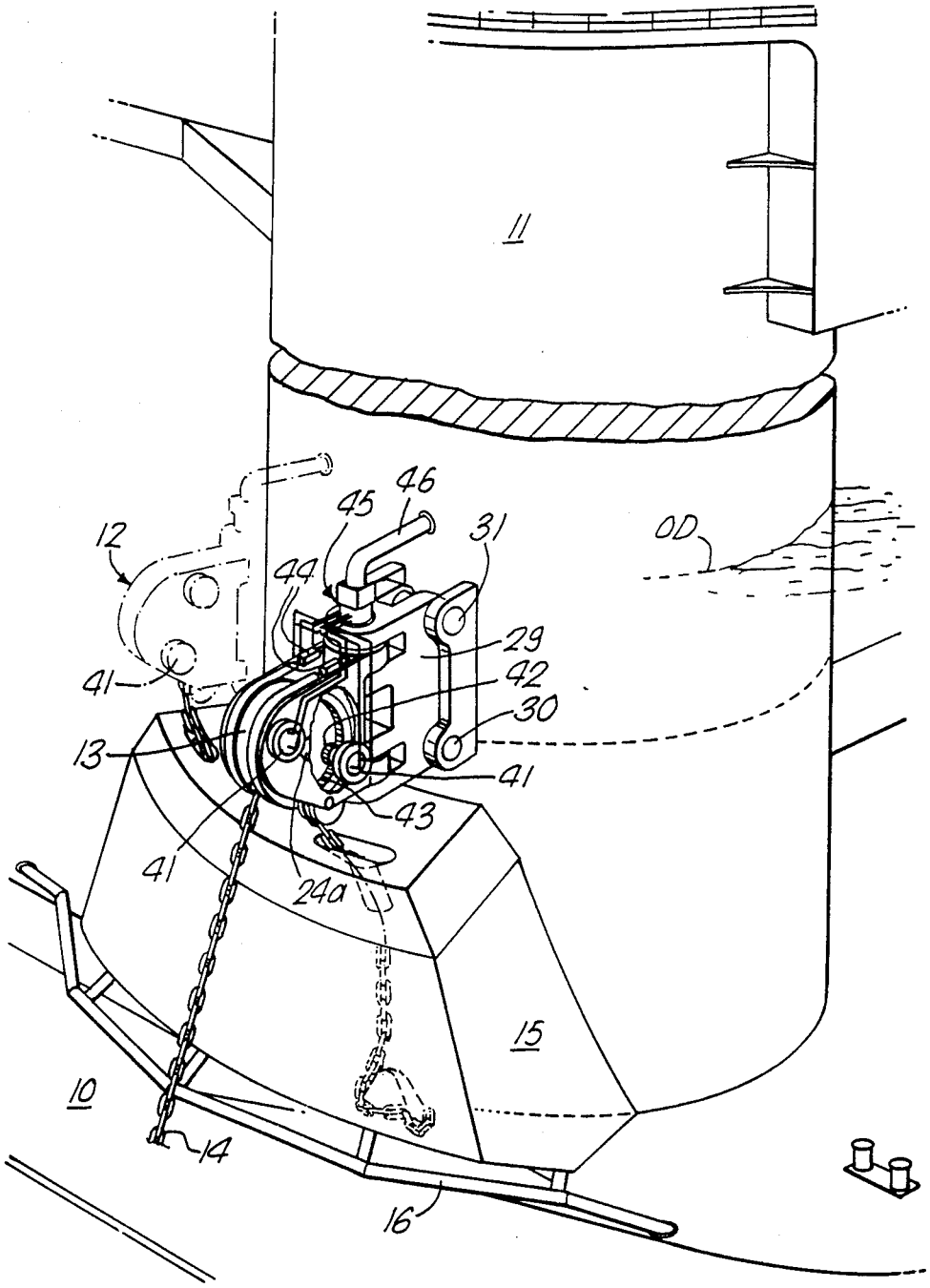
Figure 4:
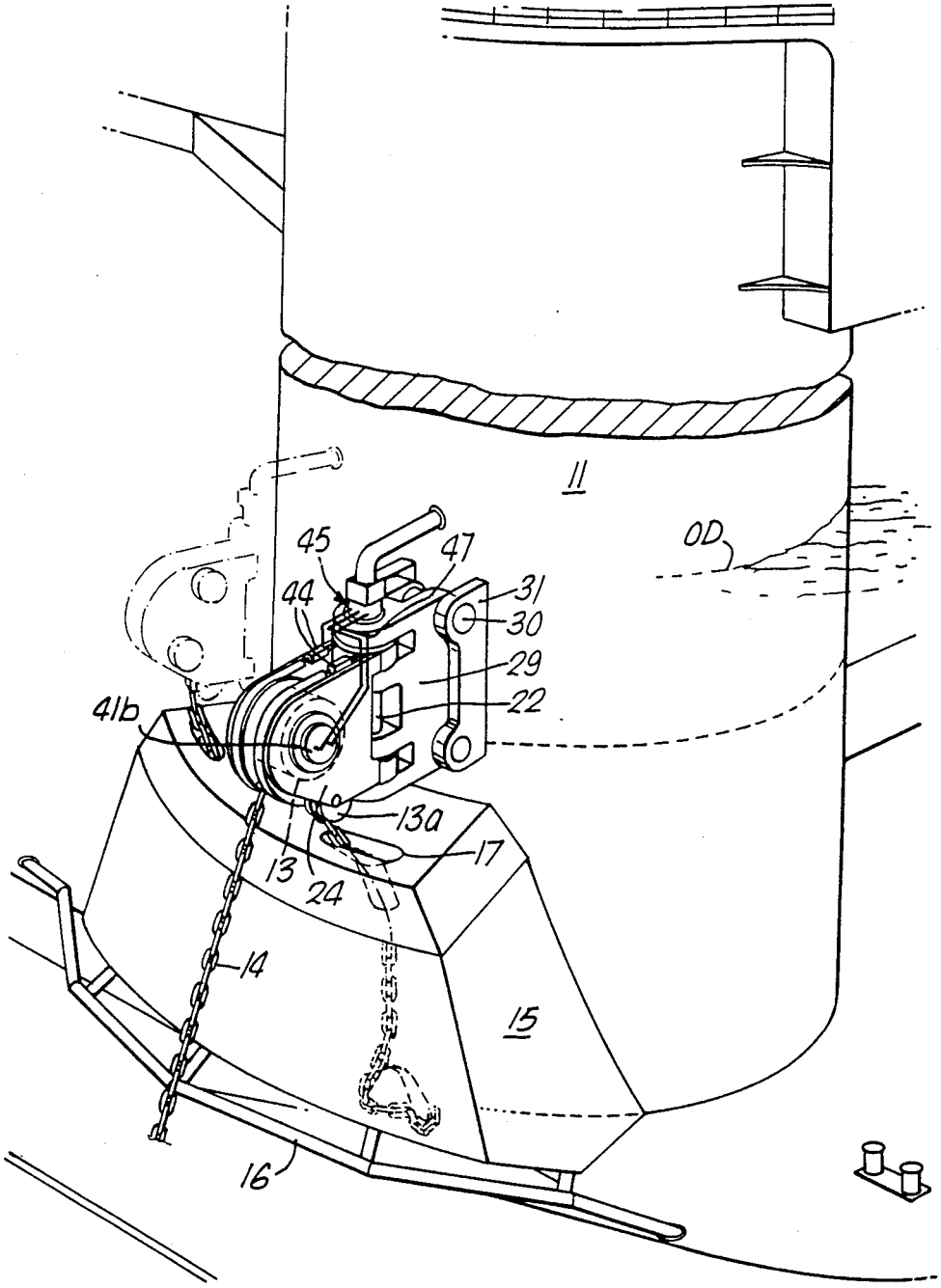

Three embodiments of the invention will be described below with reference to the appended drawings, where FIG. 1 is a perspective view of the lower part of a supporting leg and a pontoon of an offshore platform being provided with a windlass according to the invention, FIG. 2 is a vertical section through the windlass, FIG. 3 is a view corresponding to FIG. 1 and showing a second embodiment of the windlass, and FIG. 4 shows similarly a further embodiment of the invention.

In FIG. 1 a pontoon belonging to an offshore platform has been designated 10. Two such parallel pontoons 10 carry the deck structure (not shown) of the platform through supporting legs 11. On the outside of the supporting leg and facing away from the center of the platform two windlasses 12 are arranged, only one of which is schematically indicated, near the normal operating water line OD of the platform. Each windlass 12 comprises a winch motor (not shown in the drawings) located inside the supporting leg, which motor is drivingly connected to a chain wheel 13, which is pivotably supported at the supporting leg 11 through a vertical shaft. The anchor chain 14 is run from a chain box 15 over the chain wheel 13 and further on past an anchor protector 16 to the anchor (also not shown). Through the pivotability of the chain wheel about the vertical shaft the pulling direction of the chain may vary through a sector of almost 180°.

The chain box 15 is mounted on the pontoon 10 and against the outer surface of the supporting leg 11, i.e. at a level above the transit water line of the platform. The inner space of the chain box communicates with the surrounding sea water via a chain fairlead 17 and via holes in the bottom of the box when the platform is in its normal operating position.

FIG. 2 shows the location of the winch motor 18 in the supporting leg 11, having a horizontal drive shaft 19 extending through a sealing sleeve 20 in the wall of the supporting leg and having a bevel gear 21 at its free end, said bevel gear co-operating with a bevel gear 23 mounted on a vertical shaft 22. The drive shaft 19 is divided by a coupling at **19*a* and 19*b* in order to facilitate dismantling the winch motor 18 from inside the supporting leg, or the bevel gear 21, 23 with the shaft 22 and the chain wheel 13 from the outside of the leg. In order to facilitate this dismantling of the outer movable parts, the chain wheel 13 is supported by means of a shaft journal 24*a* in a wheel housing, which is supported coaxially about the shaft 22 by means of two trunnions 25 and bushings 26–28. These are in turn supported in a wheel housing holder 29, which is mounted by means of trunnions 30 extending through brackets 31 which are welded to the outside of the supporting leg 11**.

The vertical shaft 22 which is supported in the bushing 27 and a bearing 38, is provided with a worm screw 32, which is meshing with tooth segments 33 cut in the periphery of the chain wheel 13. The chain wheel has a concentric groove 34, the bottom of which is provided with a chain gripping rim 35 of the type ususally present on the winch wheel of a windlass. The anchor chain 14 is therefore in permanent engagement with the chain wheel. This engagement is enhanced by the fact that the chain runs over a idling sheave **13*a*, which is supported below the wheel 13 parallel thereto so that the chain becomes a larger wrapping angle about the wheel than if it had run directly from the chain box 15**.

By rotating the winch motor 18 in one direction or the other the chain wheel 13 may be driven so as to heave in or pay out the anchor chain 14. The engagement between the worm screw 32 and the tooth segments 33 can be made to be selflocking or nearly selflocking, which results in the tension in the chain 14 being taken up completely or in part by the elements holding the shaft 22 and the wheel 13 in engagement. This means that for instance the bevel gears 21, 23 may be dimensioned for intermittent loading. A disk brake 36, 37 is installed between the shaft 22 and the bracket 31. The axial forces on the worm screw 32 is, furthermore, taken up by a thrust bearing 39. The bevel gears 21, 23 and the disk brake 36 are enclosed by a casing 40.

FIGS. 3 and 4 show two further exemplifying embodiments of the invention. The chain wheel 13 is driven directly hydraulically. For this purpose the worm screw 32 is in FIG. 3 replaced by four hydraulic motors 41 of known design mounted on the wheel housing 24, the gears 42 of the motors meshing with inner ring gears 43 on the side of the chain wheel 13.

In FIG. 4 a hydraulic motor **41*b* of the radial piston type of known design is centrally mounted in the chain wheel. The rotating housing 13 of the hydraulic motor is bolted to and drives the chain wheel. The center of the hydraulic motor stands still and is fixedly connected to the sides of the wheel housing 24**.

The chain wheel 13 is provided with external hydraulically maneuvered band brakes 44 of known design. The hydraulic motors 41 or **41*b* are coupled to one or more hydraulic pumps installed inside the leg for providing hydraulic pressure through a swivel coupling 45, which is placed in line with the trunnions 25 and facilitates free pivotability of the wheel housing 24 with respect to the wheel housing holder 29, which is removably attached to the supporting leg 11. The hydraulic lines thus consist of fixed pipes 46 extending from the supporting leg 11 and branch lines 47 extending along the outside of the wheel housing 24**.

By the windlass described above one obtains the following advantages on an offshore platform:

A combined unit placed on the outside of the leg provides a more compact arrangement with the possibility of placing a chain box directly beneath the windlass.

Due to the lower weight and lowered center of gravity as compared to conventional arrangements the load carrying capacity on the main deck of the platform increases and, furthermore, the surface area available for such deck load and other deck arrangements increases.

Since the windlass in operating position is placed below the water surface one does not risk any spark formation when maneuvering the anchor chains and the platform may thus be moved out of a gas risk area.

Besides, the need for screening the anchor chain equipment on the main deck from gas zones disappears.

The location below the water surface provides very good cooling of parts affected by brake friction heat.

There is no need for lead-throughs in the main deck of the platform for the chain. This means that no displacement has to be disregarded in the supporting legs in case of damage with water on deck.

With this arrangement the chain length may be reduced by about 40 m per anchor line as compared to the conventional arrangements where the chain extends upwards from a chain box placed deep in the supporting leg, around the winch drum and back down along the outside of the supporting leg.

The invention is not limited to the exemplifying embodiments described above and several variations are contemplated within the scope of the appended claims. For example, the connection between the chain wheel 13 and the winch motor may be provided in other ways than using a worm drive and bevel gears or direct hydraulic drive. Furthermore, the chain wheel may be placed symmetrically between a worm wheel (which is meshing on the side of the worm screw) and a brake drum. In addition, the worm wheel may be enclosed in a casing and work in an oil bath.

I claim:

1. In an offshore platform or the like adapted to be anchored in the sea and providing therewith an operating water line (OD), the combination comprising:

(a) a platform deck support leg (11) extending through said operating water line when the platform is anchored, (b) a chain storing box (15) mounted exteriorly of said leg and adapted to be submerged below said operating water line, and with said box being filled with water so as not to contribute to the boyancy of said offshore platform, (c) a chain wheel (13) disposed above said box and rotatable about a horizontal mount and adapted to receive an anchor chain (14) extending from said box, (d) means (29) mounting said chain wheel to the exterior of said leg so that said chain wheel is submerged below said operating water line and so that an anchor chain extending between said storing box and chain wheel is disposed below said operating water line, (e) a vertical shaft (22) disposed adjacent said chain wheel below said operating water line, (f) said mounting means (d) including a wheel housing (24) mounting said chain wheel for pivotal movement about said vertical shaft, (g) and at least partially submerged drive means to rotate said chain wheel (13) about said horizontal mount.

2. The combination of claim 1 in which said drive means includes:

(a) power means (18) connected to said leg (11), (b) driving connector means (19,21,23) connected between said power means and said vertical shaft (22) to rotate the latter, (c) and a worm screw (32) mounted to said vertical shaft and drivingly engaging said chain wheel (13), (d) the construction being such that said chain wheel is both rotatably driven from said shaft as well as being pivotable thereabout.

3. The combination of claim 2 which includes means (36,37) for braking rotation of said vertical shaft (22).

4. The combination of claim 1 in which said drive means includes:

(a) at least one hydraulic motor (41) on said wheel housing (24), (b) a gear wheel (42) connected to said motor, (c) and a ring gear (43) on said chain wheel (13) and meshing with said gear wheel for being driven by the latter.

5. The combination of claim 1 in which said drive means includes:

(a) an internal, centrally mounted hydraulic motor (41b) on said chain wheel (13), (b) said hydraulic motor having a central portion fixedly connected to said wheel housing (24), (c) and said hydraulic motor having a motor housing connected to rotate with said chain wheel.

6. The combination of claim 4 or 5 which includes means (44) for braking rotation of said chain wheel (13).

* * * * *